US008733909B2

(12) United States Patent
Qin et al.

(10) Patent No.: US 8,733,909 B2
(45) Date of Patent: May 27, 2014

(54) NEGATIVE-PRESSURE INK CARTRIDGE REFILLING DEVICE, SYSTEM AND METHOD

(71) Applicant: Zhuhai Ninestar Management Co., Ltd., Zhuhai (CN)

(72) Inventors: Lei Qin, Zhuhai (CN); Weijian Chen, Zhuhai (CN)

(73) Assignee: Zhuhai Ninestar Managament Co., Ltd., Zhuhai (CN)

( * ) Notice: Subject to any disclaimer, the term of this patent is extended or adjusted under 35 U.S.C. 154(b) by 0 days.

(21) Appl. No.: 13/747,350

(22) Filed: Jan. 22, 2013

(65) Prior Publication Data

US 2013/0135402 A1 May 30, 2013

Related U.S. Application Data

(63) Continuation of application No. PCT/CN2011/072310, filed on Mar. 30, 2011.

(30) Foreign Application Priority Data

Aug. 12, 2010 (CN) ..... 2010 1 0251796

(51) Int. Cl.
*B41J 2/175* (2006.01)
*B43L 25/00* (2006.01)
*B43K 11/00* (2006.01)

(52) U.S. Cl.
CPC ..... *B41J 2/17506* (2013.01); *B41J 2/175* (2013.01); *B41J 2/17513* (2013.01); *B43L 25/007* (2013.01); *B43K 11/00* (2013.01)
USPC ..... 347/85

(58) Field of Classification Search
CPC .... B41J 2/175; B41J 2/17506; B41J 2/17513; B43L 25/007; B43K 11/00
USPC ..... 347/85
See application file for complete search history.

(56) References Cited

U.S. PATENT DOCUMENTS 5,663,754 A * 9/1997 Lorenze et al. ..... 347/87
6,116,722 A * 9/2000 Sato et al. ..... 347/85

(Continued)

FOREIGN PATENT DOCUMENTS

CN 1795103 A 6/2006
CN 201483892 U 5/2010

(Continued)

OTHER PUBLICATIONS

International Search Report of International Application No. PCT/CN2011/072310, dated Jun. 16, 2011.

*Primary Examiner* — Stephen Meier
*Assistant Examiner* — Alexander D Shenderov
(74) *Attorney, Agent, or Firm* — J.C. Patents

(57) ABSTRACT

The invention relates to a negative-pressure ink cartridge refilling device, system and method. The device comprises an ink container used to store ink, an ink injection channel, an aspirator and a suction channel communicated with the ink container, wherein one end of the ink injection channel is an ink inlet end while the other end is an ink outlet end connected with the ink cartridge to be refilled; a sucking opening connected with the aspirator is formed on the suction channel; and the inlet end is disposed above the ink level surface of the ink container. Therefore, the ink in the ink container cannot be overflowed via the ink injection channel regardless of the environmental factors, and thus the technical problem that the phenomenon of ink splash tends to occur when the traditional negative-pressure ink cartridge refilling device is used by a user for the first time can be solved.

16 Claims, 9 Drawing Sheets

(56) References Cited

U.S. PATENT DOCUMENTS

| | | | | |
|---|---|---|---|---|
| 6,172,695 | B1 * | 1/2001 | Liu | 347/85 |
| 6,386,691 | B1 * | 5/2002 | Liu | 347/85 |
| 2005/0275699 | A1 | 12/2005 | Sasaki | 347/85 |
| 2007/0024683 | A1 | 2/2007 | Yan | 347/86 |
| 2009/0040281 | A1 | 2/2009 | Sulser | 347/86 |
| 2010/0214375 | A1 * | 8/2010 | Sulser et al. | 347/85 |

FOREIGN PATENT DOCUMENTS

| | | | |
|---|---|---|---|
| CN | 201784253 | U | 4/2011 |
| CN | 101623956 | B | 7/2012 |
| WO | WO2004/106072 | A1 | 12/2004 |

* cited by examiner

NEGATIVE-PRESSURE INK CARTRIDGE REFILLING DEVICE, SYSTEM AND METHOD

CROSS-REFERENCE TO RELATED APPLICATIONS

This application is a continuation of International Patent Application No. PCT/CN2011/072310, filed on Mar. 30, 2011, which claims priority to Chinese Patent Application No. 201010251796.X, filed on Aug. 12, 2010. The contents of the above identified applications are incorporated herein by reference in their entirety.

FIELD OF THE TECHNOLOGY

The invention mainly relates to a refilling device, system and method used for refilling an inkjet ink cartridge, in particular to a negative-pressure ink cartridge refilling device, system and method.

BACKGROUND

The printing means of an inkjet printer is usually as follows: an ink cartridge used for receiving ink provides an ink source and ink is conveyed to a printhead via a corresponding ink flow channel and driven by a print signal to be ejected to a recording medium such as a piece of paper via a nozzle on the printhead, so as to complete the recording of characters or graphs.

There are two types of ink cartridges for inkjet printers according to the arrangement relationship between the printheads and the ink cartridges: one is integrated type ink cartridges and the other is split type ink cartridges. A printhead of an integrated type ink cartridge is integrated into a whole with an ink storage cavity and arranged on an ink outlet of the ink cartridge. A printhead of a split type ink cartridge is mutually separated from an ink storage cavity which only receives ink and arranged on a cartridge unit of an inkjet printer. As the printheads of the integrated type ink cartridges are easy to damage and relatively expensive, more and more users select the split type ink cartridges.

There is a common split type ink cartridge on the market currently. The structure of the split type ink cartridge is as follows: the ink cartridge comprises a negative-pressure cavity and an ink cavity, wherein the two cavities are connected with each other via a communicating opening; a sponge used for generating a capillary force to hold ink and an ink outlet connected with an ink supply needle of a printer are formed inside the negative-pressure cavity; and an ink injection opening is formed inside the ink cavity. Obviously, as the split type ink cartridge is directly thrown away after the ink is out, most components of the split type ink cartridge, such as plastics and membranes, cannot be naturally degraded, the resource waste and environmental pollution tend to be caused. Therefore, the preferred means is for the ink cartridge of which the ink is out to be subjected to ink refilling and be reutilized.

The Chinese patent CN200910109293.6 provides a negative-pressure ink cartridge refilling device, which comprises an ink container, an ink supply pipe, a suction channel and an aspirator, wherein the ink container is used for storing ink for refilling; the ink supply pipe is used for conveying the ink to an ink cartridge to be refilled; the suction channel and the aspirator are disposed above the ink container; and the suction channel is directly connected with the ink container and connected with the aspirator to suck air in the ink container.

The process of utilizing the negative-pressure ink cartridge refilling device to refill the split type ink cartridge mentioned above is as follows: firstly, the ink cartridge to be refilled is fixed on the refilling device; herein, an ink outlet of the ink cartridge is connected with the ink supply pipe, and a closed space is formed between the ink container and the ink cartridge; secondly, the aspirator is connected with the suction channel to suck air in the ink container and the ink cartridge; and thirdly, the aspirator is loosened, and herein, the ink cartridge automatically absorbs the ink in the ink container due to the gas-pressure balance, namely the ink enters into the negative-pressure cavity via the ink supply pipe and enters into the ink cavity via the communicating opening.

During the conveying of the ink cartridge refilling device, the pressure in the ink container may be raised due to the variation of environmental factors such as temperature rise. As an ink inlet end of the ink supply pipe is always immersed into the ink, the ink may enter into the ink supply pipe under the pressure. At that moment, if a sealing component of the ink supply pipe is opened by a user, the ink in the ink supply pipe may splash out, and then the environment may be polluted and hands and clothes of the user may be dirtied.

Moreover, after the ink cartridge is refilled, due to the barrier effect of the ink in the ink supply pipe, there is almost no negative pressure in the ink cartridge. Therefore, when the ink cartridge is removed, the sponge of the negative-pressure cavity is in the saturated state, and then the phenomenon of ink drop tends to occur.

SUMMARY

The invention provides a negative-pressure ink cartridge refilling device, system and method to solve the technical problem that the phenomenon of ink splash tends to occur when the traditional negative-pressure ink cartridge refilling device is initially used by a user.

In order to solve the technical problem, the invention adopts the technical proposal that:

The invention relates to a negative-pressure ink cartridge refilling device for refilling ink into an ink cartridge to be refilled, which comprises:

an ink container, in which the ink container is used for storing the ink to be refilled into the ink cartridge to be refilled;

an ink injection channel, in which the ink injection channel is used for conveying the ink to the ink cartridge to be refilled; one end of the ink injection channel is an inlet end through which the ink in the ink container enters into the ink injection channel and the other end of the ink injection channel is an outlet end connected with the ink cartridge to be refilled; and the inlet end is disposed above the ink level surface of the ink container;

an aspirator, in which the aspirator is used for sucking air in the ink cartridge refilling device; and a suction channel, in which the suction channel is communicated with the ink container and provided with a sucking opening connected with the aspirator.

The inlet end and the sucking opening are respectively close to or disposed on two relative sidewalls on the ink container.

The negative-pressure ink cartridge refilling device also comprises an ink cartridge positioning mechanism connected with the ink container and used for fixing the ink cartridge to be refilled into the ink cartridge refilling device.

A clamping groove is formed on one sidewall of the ink cartridge positioning mechanism.

The ink cartridge positioning mechanism and the ink container are subjected to integrated molding or integrated into a whole by welding or clamping.

The negative-pressure ink cartridge refilling device also comprises an upper cover connected with the ink cartridge positioning mechanism; and a sealing component used for hermetically fixing the ink cartridge into the ink cartridge refilling device is also arranged on the upper cover.

One end of the upper cover is articulated with one end of the ink cartridge positioning mechanism and the other end of the upper cover is provided with a clamping fastener engaged with the clamping groove.

A sealing mechanism used for sealing is arranged at the outlet end and consists of a seal ring, a rubber plug and a sleeve; a recess is formed inside the seal ring and engaged with the rubber plug; and the sleeve is engaged with the rubber plug.

The sucking opening is provided with a self-closed seal ring used for sealing.

The invention also provides a negative-pressure ink cartridge refilling system, which comprises the ink cartridge to be refilled and the negative-pressure ink cartridge refilling device.

The outlet end is disposed on the upstream of the ink-flow gravity direction of the ink cartridge in the case of refilling.

The outlet end is connected with an ink outlet of the ink cartridge to be refilled.

The invention also provides a method for utilizing the negative-pressure ink cartridge refilling system for refilling, which can further solve the problem that the phenomenon of ink drop tends to occur after the ink cartridge is refilled and comprises the following steps of:

A. rotating the negative-pressure refilling system until the outlet end of the ink injection channel is disposed on the upstream of the ink-flow gravity direction of the ink cartridge to be refilled;

B. allowing the aspirator to be connected with the sucking opening for negative-pressure ink injection; and C. rotating the negative-pressure refilling device until the inlet end is disposed above the ink level surface of the ink container.

The step B comprises the following steps of:

a. pulling the aspirator to suck the air in the ink container; and b. loosening the aspirator, in which the ink cartridge to be refilled automatically absorbs the ink in the ink container due to the gas-pressure balance.

The refilling method also comprises step D after the step C: removing the ink cartridge from the ink cartridge refilling device and sealing the outlet end via the sealing mechanism.

By adoption of the technical proposal, as the inlet end is disposed above the ink level surface of the ink container, the ink in the ink container cannot be overflowed via the ink injection channel regardless of environmental factors, and then the technical problem that the phenomenon of ink splash tends to occur when the traditional negative-pressure ink cartridge refilling device is initially used by a user can be solved. In addition, the ink cartridge is removed after the refilling device finishing the refilling is rotated until the inlet end is disposed above the ink level surface of the ink container, and then the phenomenon of ink drop after the ink cartridge is removed can be avoided.

BRIEF DESCRIPTION OF THE DRAWINGS

For more clear description of the embodiments of the invention or the technical proposal in the prior art, simple description is given to the drawings required to be used in the illustration of the embodiments or the prior art. Obviously, the drawings as illustrated below are only some embodiments of the invention and other drawings can also be obtained by those skilled in the art on the basis of the drawings without providing creative labor.

Description of reference signs: 1—ink cartridge refilling device; 2—ink container; 3—ink injection channel; 31—outlet end; 32—inlet end; 4—suction channel; 41—sucking opening; 5—ink cartridge positioning mechanism; 51—rib; 52—clamping groove; 6—upper cover; 61—sealing component; 611—projection; 612—silicone sleeve; 62—clamping fastener; 7—seal ring; 8—rubber plug; 9—sleeve; 10—self-closed seal ring; 11—holding section; 12—aspirator; 121—cylinder; 122—handle; 123—piston; 124—piston rod; 13—slide-proof washer; 14—slide-proof washer; 15—ink cartridge; 151—negative-pressure cavity; 1511—sponge; 152—ink cavity; 153—partition wall; 1531—communicating opening; 154—ink outlet; 155—ink injection opening; 156—gas-guide opening; 157—cotton core; 158—movable member; 159—first engagement section; and 160—second engagement section.

DETAILED DESCRIPTION

For the objectives, technical proposals and advantages of the embodiments of the invention to be more clear, a clear and complete description is given below to the technical proposals in the embodiments of the invention with the attached drawings in the embodiments of the invention. Obviously, the embodiments illustrated are only one part of embodiments of the invention but not all the embodiments. All the other embodiments obtained by those skilled in the art on the basis of the embodiments of the invention without providing creative labor shall be all within the scope of protection of the invention.

The main technical proposal of the invention is that: an inlet end of an ink injection channel is disposed above the ink level surface of an ink container; and when the ink cartridge to be refilled is refilled, an ink cartridge must be rotated for a certain angle after the ink cartridge is refilled, so that the inlet end is varied from being immersed into ink to being disposed above the ink level surface. Obviously, by adoption of the technical proposal, the ink is difficult to enter into the ink injection channel even in the case of pressure rise in the ink container during the conveying of the ink cartridge refilling device. Therefore, only air is discharged when the ink cartridge refilling device is initially used by a user, and the phenomenon of ink splash may not occur. Moreover, there is certain negative pressure in the ink cartridge, so that the phenomenon that a sponge is oversaturated when the ink cartridge is removed can be avoided.

Further detailed description is given to the technical proposal of the invention with the attached drawings and preferred embodiments.

Figure 1:
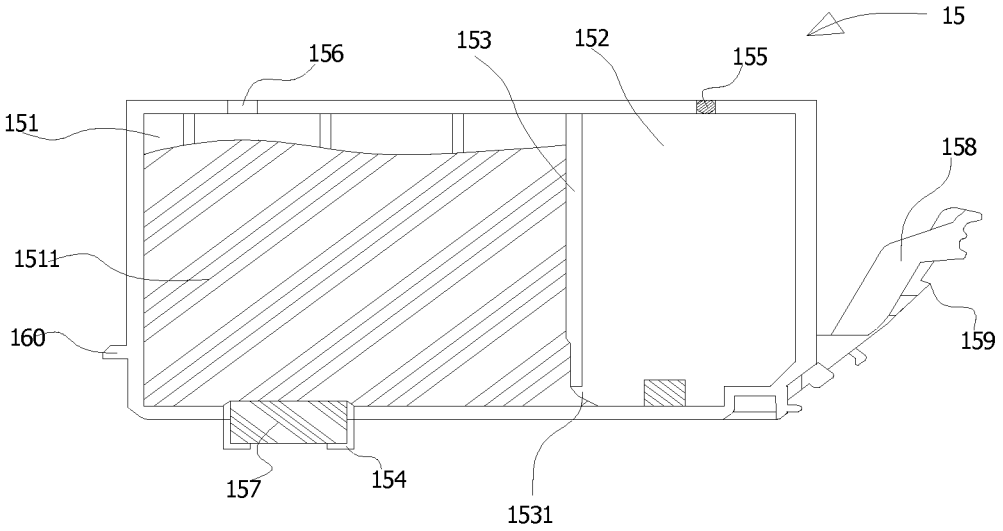
FIG. 1 is a structure diagram of an ink cartridge to be refilled in the embodiment of the invention.

FIG. 1 is a structure diagram of the ink cartridge to be refilled in the embodiment. As illustrated in FIG. 1, the ink cartridge 15 is divided into a negative-pressure cavity 151 and an ink cavity 152 via a partition wall 153; and the negative-pressure cavity 151 and the ink cavity 152 are connected with each other via a communicating opening 1531 disposed under the partition wall 153, so that a closed space is basically formed in the ink cavity 152 except from the communicating opening 1531. Wherein, an absorbing member for holding ink is arranged inside the negative-pressure cavity 151 and mostly made from a porous material such as a sponge 1511; an ink outlet 154 for supplying ink to a printhead of a printer is formed on the lower wall of the negative-pressure cavity 151; and a gas-guide opening 156 for conveying outside air to the ink cartridge 15 is formed on the upper wall of the negative-pressure cavity 151. Therefore, when ink in the negative-pressure cavity 151 is consumed for recording, ink in the ink cavity 152 enters into the negative-pressure cavity 151 via the communicating opening 1531; and meanwhile, air in the negative-pressure cavity 151 also enters into the ink cavity 152 via the communicating opening 1531, namely the ink in the ink cavity 152 and the air in the negative-pressure cavity 151 are exchanged via the communicating opening 1531. Moreover, along with the continuous exchange of the air in the negative-pressure cavity 151 and the ink in the ink cavity 152, outside air can enter into the negative-pressure cavity 151 via the gas-guide opening 156.

In addition, a cotton core 157 is also arranged inside the ink outlet 154 in most cases; the density of the cotton core 157 is higher than that of the sponge 1511 in the negative-pressure cavity 151; and when the ink cartridge 15 is used for printing, the cotton core 157 is used for guiding the ink to flow to the ink outlet 154. Moreover, an ink injection opening 155 is also formed on the ink cartridge 15, disposed above the ink cavity 152, and usually sealed by a steel ball after initial ink injection, so as to avoid the phenomenon of ink leakage during the conveying or use of the ink cartridge 15. Meanwhile, a prism used for detecting the ink level of the ink cavity 152 is also arranged on the ink cartridge 15 and disposed on the lower wall of the ink cavity 152. The process of utilizing the prism to detect the ink level is a mature technique in the field and not illustrated in detail here. As illustrated in FIG. 1, the ink cartridge 15 also has a second engagement section 160 and a movable member 158 provided with a first engagement section 159. The first engagement section 159 and the second engagement section 160 can be engaged with corresponding members of the printer to fix the ink cartridge 15 into the printer when the ink cartridge 15 is installed on the printer.

Figure 2A:
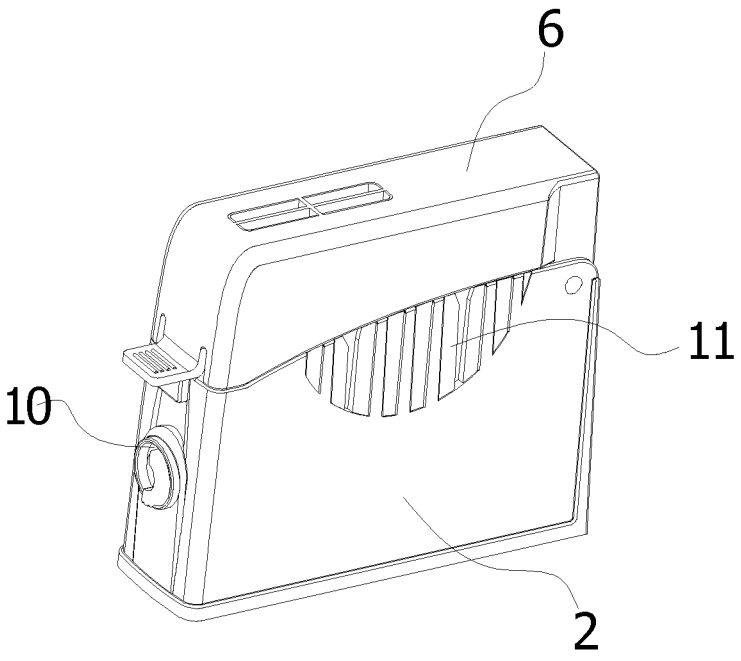
FIG. 2*a* is a front view of an ink cartridge refilling device in the embodiment of the invention.
Figure 2B:
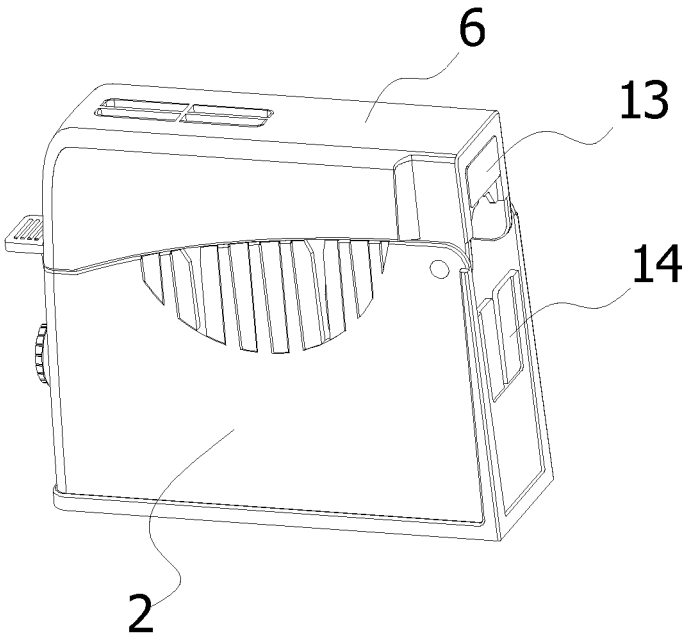
FIG. 2*b* is a rear view of the ink cartridge refilling device in the embodiment of the invention.
Figure 3:
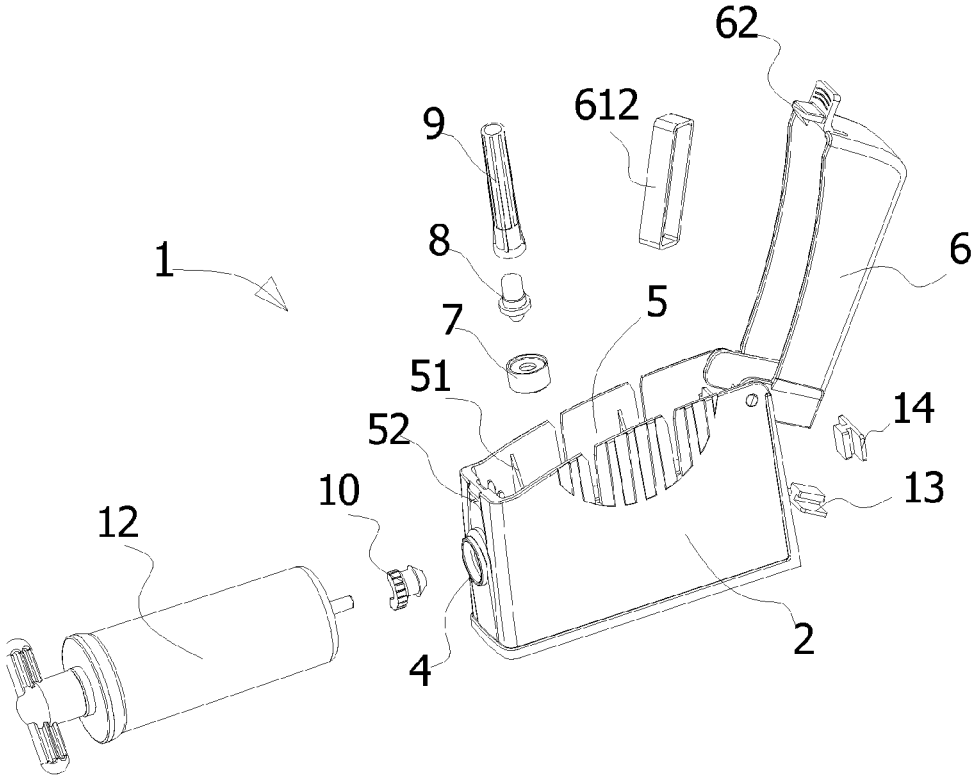
FIG. 3 is an exploded view of the ink cartridge refilling device in the embodiment of the invention.
Figure 4A:
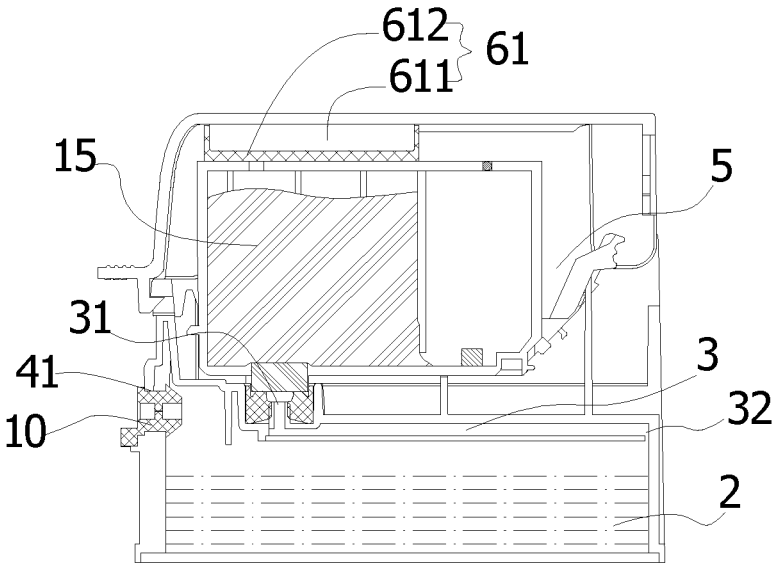
FIG. 4*a* is a schematic diagram illustrating the engagement of the ink cartridge to be refilled and the ink cartridge refilling device in the embodiment of the invention.
Figure 4B:
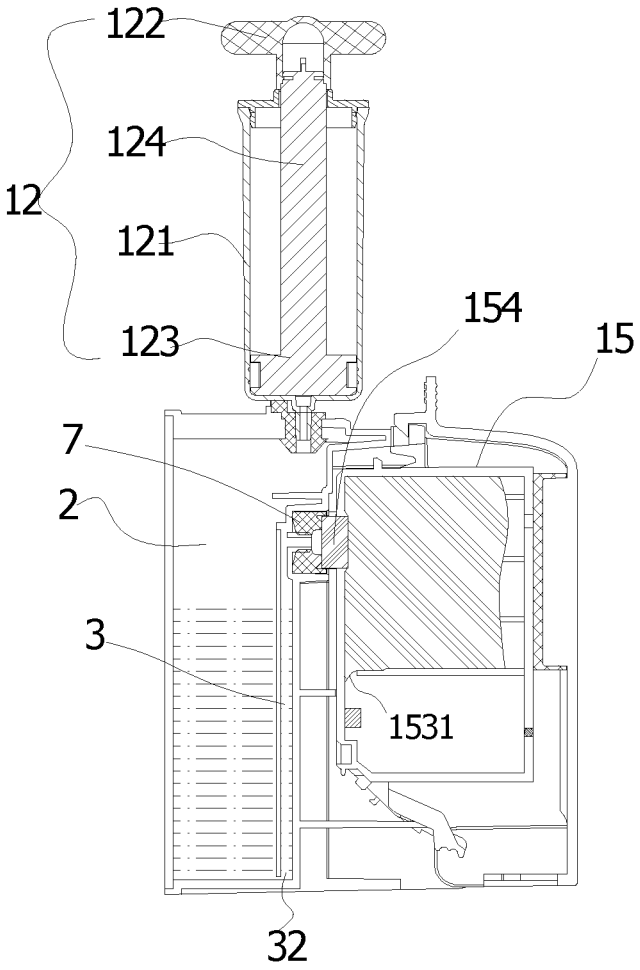
FIG. 4*b* is a location diagram illustrating the state when the ink cartridge refilling device in the embodiment of the invention is used for refilling.
Figure 4C:
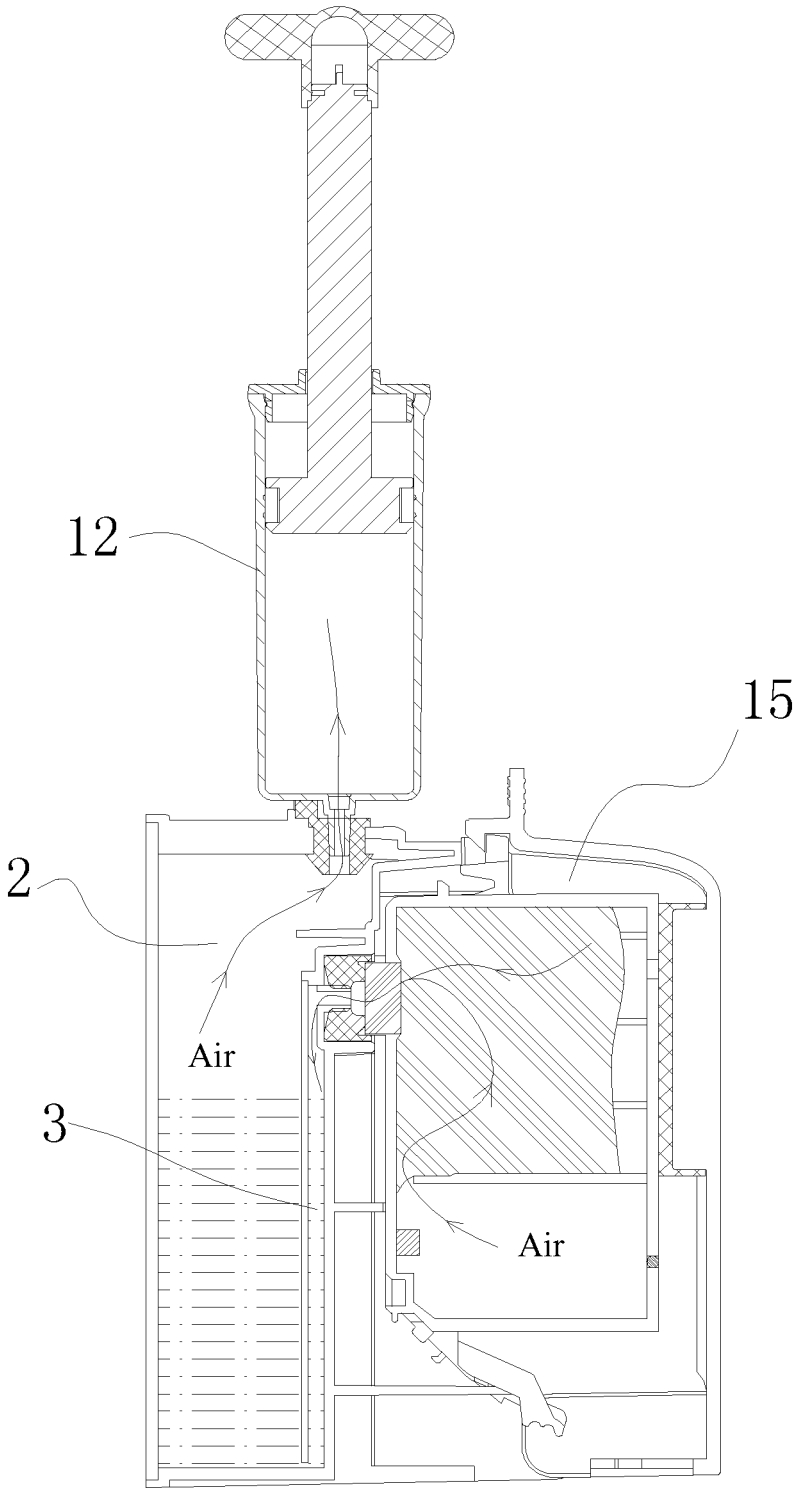
FIG. 4*c* is a schematic diagram illustrating the suction action when the ink cartridge refilling device in the embodiment of the invention is used for refilling.

FIG. 2*a* is a front view of the ink cartridge refilling device in the embodiment of the invention; FIG. 2*b* is a rear view of the ink cartridge refilling device in the embodiment of the invention; FIG. 3 is an exploded view of the ink cartridge refilling device in the embodiment of the invention; FIG. 4*a* is a schematic diagram illustrating the engagement of the ink cartridge to be refilled and the ink cartridge refilling device in the embodiment of the invention; and FIG. 4*b* is a location diagram illustrating the state when the ink cartridge refilling device in the embodiment of the invention is used for refilling. As illustrated in FIGS. 2*a* to 4*a*, the ink cartridge refilling device 1 comprises an ink container 2, an ink injection channel 3, a suction channel 4, an aspirator 12, an ink cartridge positioning mechanism 5 and an upper cover 6, wherein the ink container 2 is used for storing ink to be refilled into the ink cartridge 15 to be refilled; the ink injection channel 3 is used for conveying the ink in the ink container 2 to the ink cartridge 15 and has an outlet end 31 connected with the ink outlet 154 of the ink cartridge 15 and an inlet end 32 used for guiding the ink to flow into the ink injection channel 3 from the ink container 2; the suction channel 4 is communicated with the ink container 2, provided with a sucking opening 41, and used for sucking air in the ink container 2 and the ink cartridge 15 in the case of refilling, so as to form negative pressure in the ink container 2 and the ink cartridge 15; the aspirator 12 is connected with the sucking opening 41 of the suction channel 4 to suck the air in the ink container 2 and the ink cartridge 15 and consists of a cylinder 121, a piston 123, a piston rod 124 and a handle 122; the piston rod 124 is fixedly connected with the piston 123 which can move up and down in the cylinder 121 to suck or discharge air; the ink cartridge positioning mechanism 5 is used for positioning the ink cartridge 15 into the ink cartridge refilling device 1, provided with corresponding members engaged with the first engagement section 159 and the second engagement section 160 of the ink cartridge 15, and can be integrated into a whole with the ink container 2 by clamping or welding and preferably by injection molding in the embodiment; as illustrated in FIG. 3, for better restriction of the position of the ink cartridge 15 in the ink cartridge positioning mechanism 5, a rib 51 is also formed inside the ink cartridge positioning mechanism 5 and a clamping groove 52 is formed on one sidewall of the ink cartridge positioning mechanism 5; one end of the upper cover 6 is connected with the ink cartridge positioning mechanism 5 via a hinge, namely the upper cover 6 can rotate for a certain angle around the ink cartridge positioning mechanism 5; and a clamping fastener 62 is formed at the other end of the upper cover 6 and can be engaged with the clamping groove 52 formed on the sidewall of the ink cartridge positioning mechanism 5 by fastening, so that the ink cartridge 15 can be fixed into the ink cartridge refilling device 1 by the upper cover 6 after the ink cartridge 15 is installed into the ink cartridge positioning mechanism 5.

As illustrated in FIG. 4*a*, a sealing component 61 is also arranged on the upper cover 6 to hermetically fix the ink cartridge 15 into the ink cartridge refilling device 1 and consists of a projection 611 and a silicone sleeve 612, wherein the projection 611 is formed inside the upper cover 6 and corresponds to the gas-guide opening 156 on the ink cartridge 15, and more specifically, the projection 611 can cover the gas-guide opening 156 after the upper cover 6 and the ink cartridge positioning mechanism 5 are engaged with each other by fastening; and the silicone sleeve 612 is made of elastic materials and can enclose the projection 611 as the dimension of the silicone sleeve 612 is equivalent to that of the projection 611. Therefore, when the upper cover 6 is rotated to fix the ink cartridge 15, the gas-guide opening 156 can be sealed by the sealing component 61 to prevent the outside air from entering into the ink cartridge 15, so that a closed space is basically formed in the ink cartridge 15 except that the ink outlet 154 is connected with the ink container 2. More specifically, a closed space is formed between the ink cartridge refilling device 1 and the ink cartridge 15. It can be also said that the sealing component 61 also has the function of limiting the ink cartridge 15, so that the ink cartridge 15 cannot move up and is guaranteed to be fully fixed into the ink cartridge refilling device 1.

As illustrated in FIG. 4*a*, the inlet end 32 of the ink injection channel 3 is disposed above the ink level surface of the ink container 2, so that there is all air and no ink in the ink injection channel 3 when the ink cartridge refilling device 1 is not used. Therefore, the ink cannot enter into the ink injection channel 3 during the conveying even in the case of pressure rise of the ink container 2 due to the variation of environmental factors or other reasons. Consequently, only the air in the ink injection channel 3 is discharged when the ink cartridge refilling device 1 is initially used by the user and a sealing mechanism at the outlet end 31 is pulled out, so that the phenomenon of ink splash can be avoided, and then the phenomenon that the environment is polluted by the ink or the hands or clothes of the user are dirtied by the ink can be avoided.

As illustrated in FIGS. 3 and 4*a*, the ink cartridge refilling device 1 also comprises the sealing mechanism used for sealing the outlet end 31 of the ink injection channel 3. In the embodiment, the sealing mechanism consists of a seal ring 7, a rubber plug 8 and a sleeve 9, wherein the seal ring 7 is made of elastic materials such as silicone and rubber and provided with a recess; a self-closed slot is formed in the middle of the recess and can be selectively closed or opened according to the pressure difference on both sides; the seal ring 7 is engaged with the outlet end 31; the rubber plug 8 has an upper section and a lower section; and the diameter of the lower section is equivalent to that of the recess of the seal ring 7 and the diameter of the upper section is equivalent to the inside diameter of the sleeve 9, so that the rubber plug 8 is engaged with the recess of the seal ring 7 and the sleeve 9 is engaged with the rubber plug 8. Due to the arrangement, the phenomenon of ink leakage as the self-closed slot of the seal ring 7 is opened due to the action of the pressure difference between the ink container and the outside air during the conveying of the ink cartridge 15 refilling device such as air transport can be avoided. That is to say, by adoption of the structure, when the self-closed slot of the seal ring 7 is opened, the ink cannot flow out due to the plugging of the rubber plug 8. The sleeve 9 is made of engineering plastics and the rubber plug 8 is made of rubber or silicone materials. The reason is as follows: for the miniaturization of the ink cartridge refilling device 1, a space on the upper part of the ink cartridge refilling device 1, for receiving the ink cartridge 15, is relatively narrow, so the user need to stretch the hand into the narrow space to remove the rubber plug 8 when the ink cartridge refilling device 1 is used if only the rubber plug 8 is used for sealing the recess, which is troublesome; therefore, due to the arrangement of the sleeve 9 which can be integrated into a whole with the rubber plug 8 and of which the length is relatively long but slightly less than the height of the ink cartridge positioning mechanism 5, the user only need to pull out the sleeve 9 when the ink cartridge refilling device 1 is used, and then the rubber plug 8 can be pulled out and the ink injection channel 3 can be opened, which is simple and convenient.

In addition, in the embodiment, the sucking opening 41 of the suction channel 4 is sealed by a self-closed seal ring 10 which is made of silicone materials and has good elasticity; a cavity is formed in the middle of the self-closed seal ring 10; and a self-closed slot running through a wall of the cavity, communicated with the suction channel 4, is formed on the wall. The self-closed slot is closed in normal times and opened when the aspirator 12 is inserted, so that the aspirator 12 is communicated with the ink container 2. As illustrated in FIG. 2*a*, the ink cartridge refilling device 1 also has a holding section 11 which provides convenience for the user to hold the ink cartridge refilling device 1, wherein the holding section 11 is formed by a plurality of grooves parallel to the outerwall of the ink cartridge refilling device 1 and can also be used as a connecting section between adjacent refilling devices. Herein, a projection (not illustrated in the figure) of which the shape is consistent with that of the grooves is only required to be formed outside another refilling device, so that convenience is provided for the user to connect a plurality of refilling devices for holding ink of different colors. As illustrated in FIGS. 2*b* and 3, slide-proof washers 13 and 14 are respectively arranged on one side of the upper cover 6 and one side of the ink container 2, relative to the suction channel 4, and made of materials with certain friction force or resistance, so as to guarantee that the ink cartridge refilling device is difficult to slide in the case of refilling and fully guarantee smooth refilling.

For the user to clearly observe the ink cartridge refilling state, the ink cartridge refilling device 1 is preferably made of transparent materials in the embodiment.

Description is given to the use of the ink cartridge refilling device 1 according to FIGS. 2*a* to 5.

(1) Placing the ink cartridge refilling device 1 on a plane; holding the sleeve 9; and then pulling out the rubber plug 8.

(2) As illustrated in FIG. 4*a*, firstly, opening the upper cover 6 and placing the ink cartridge 15 on the ink cartridge refilling device 1. Herein, the movable member 158, the first engagement section 159 and the second engagement section 160 of the ink cartridge 15 are respectively engaged with corresponding members of the ink cartridge positioning mechanism 5 of the ink cartridge refilling device 1 to fix the ink cartridge 15 into the ink cartridge refilling device 1, and the ink outlet 154 of the ink cartridge 15 is guaranteed to be connected with the outlet end 31 of the ink injection channel 3. Secondly, rotating the upper cover 6, so that the clamping fastener 62 on the upper cover 6 is correspondingly engaged with the clamping groove 52 of the ink cartridge positioning mechanism 5 by fastening, and thus the sealing component 61 of the upper cover abuts against the ink cartridge 15 and seals the gas-guide opening 156 on the ink cartridge 15, and consequently the ink cartridge 15 is fixed into the ink cartridge refilling device 1. Herein, the communicating opening 1531 of the ink cartridge 15 is disposed above the outlet end 31; the inlet end 32 of the ink injection channel 3 is disposed above the ink level surface of the ink container 2; and a closed space, namely an ink cartridge refilling system, is formed by the ink cartridge refilling device 1 and the ink cartridge 15.

(3) Rotating the whole ink cartridge refilling system 1 clockwise at an angle of 90 DEG, so that the surface provided with the slide-proof washers 13 and 14 is in contact with the plane, and thus the ink cartridge refilling device 1 can be guaranteed to be unable to slide on the plane due to the rubbing effect between the slide-proof washers 13 and 14 and the plane. Herein, the inlet end 32 of the ink injection channel 3 is immersed into the ink and the suction channel 4 is disposed above the ink container 2. What is most important, the ink outlet 154 of the ink cartridge 15 is disposed above the communicating opening 1531, namely the outlet end 31 of the ink injection channel 3 is disposed on the upstream of the ink-flow gravity direction of the ink cartridge 15 to be refilled.

(4) As illustrated in FIG. 4*b*, firstly, inserting the aspirator 12 prepared in advance into the sucking opening 41 of the suction channel 4, so that the self-closed slot of the self-closed seal ring 10 is opened and the aspirator 12 is communicated with the ink container 2. Secondly, holding the handle 122 of the aspirator 12 and pulling the piston rod 124 to drive the piston 123 to move up, and then the air in the ink container 2 may flow to the aspirator 12 along the directions shown by the arrowheads illustrated in FIG. 4*c*. Herein, the self-closed slot of the seal ring 7 is opened due to the action of pressure difference on both sides of the ink container 2 and the ink cartridge 15, so that the air in the ink cartridge 15 may also flow to the ink container 2 via the ink injection channel 3 and flow to the aspirator 12 along the directions shown by the arrowheads, and thus certain negative pressure may be formed in the ink container 2 and the ink cartridge 15.

Figure 4D:
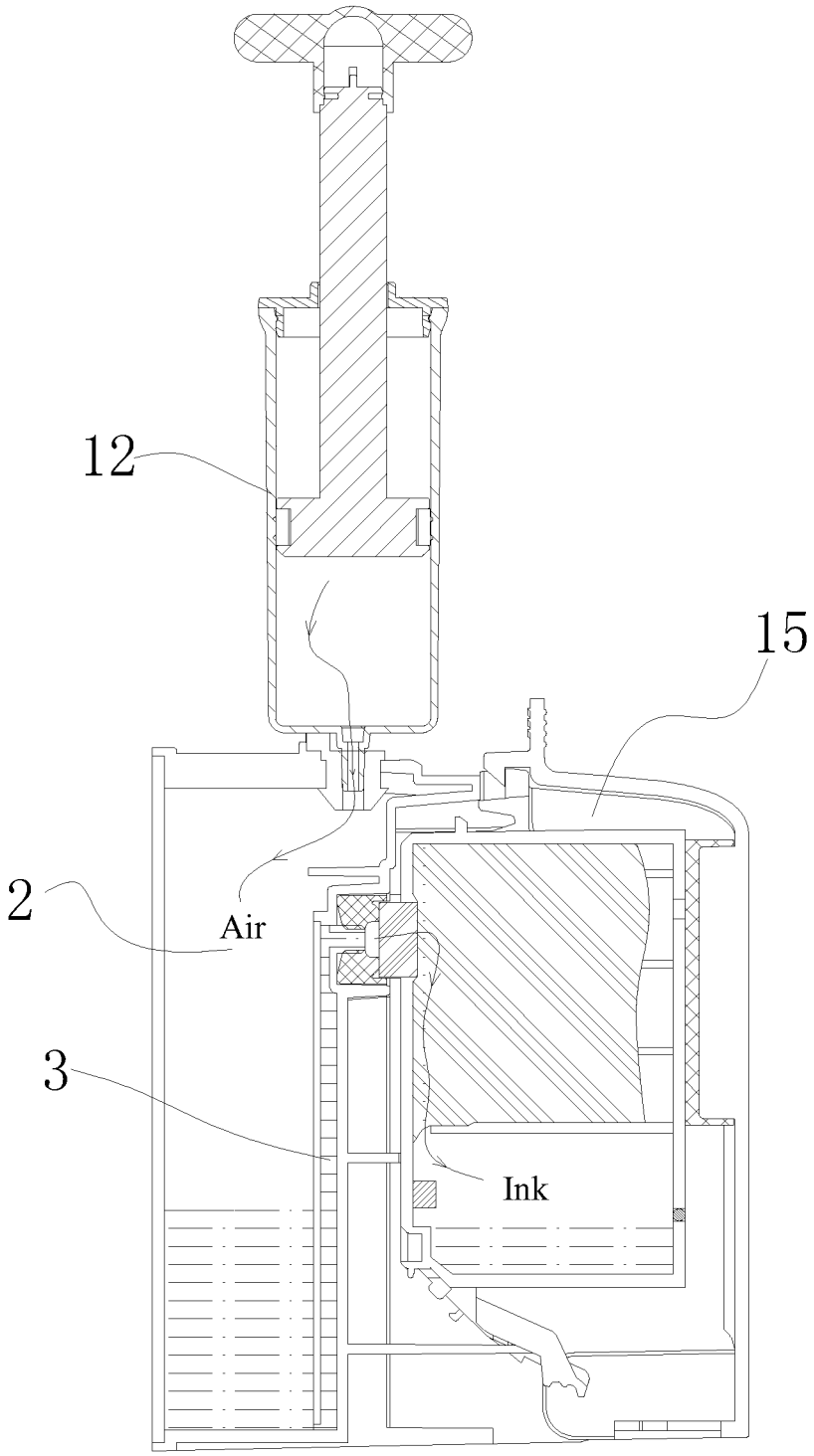
FIG. 4*d* is a schematic diagram illustrating the state when the ink cartridge refilling device in the embodiment of the invention is used for ink injection.
Figure 4E:
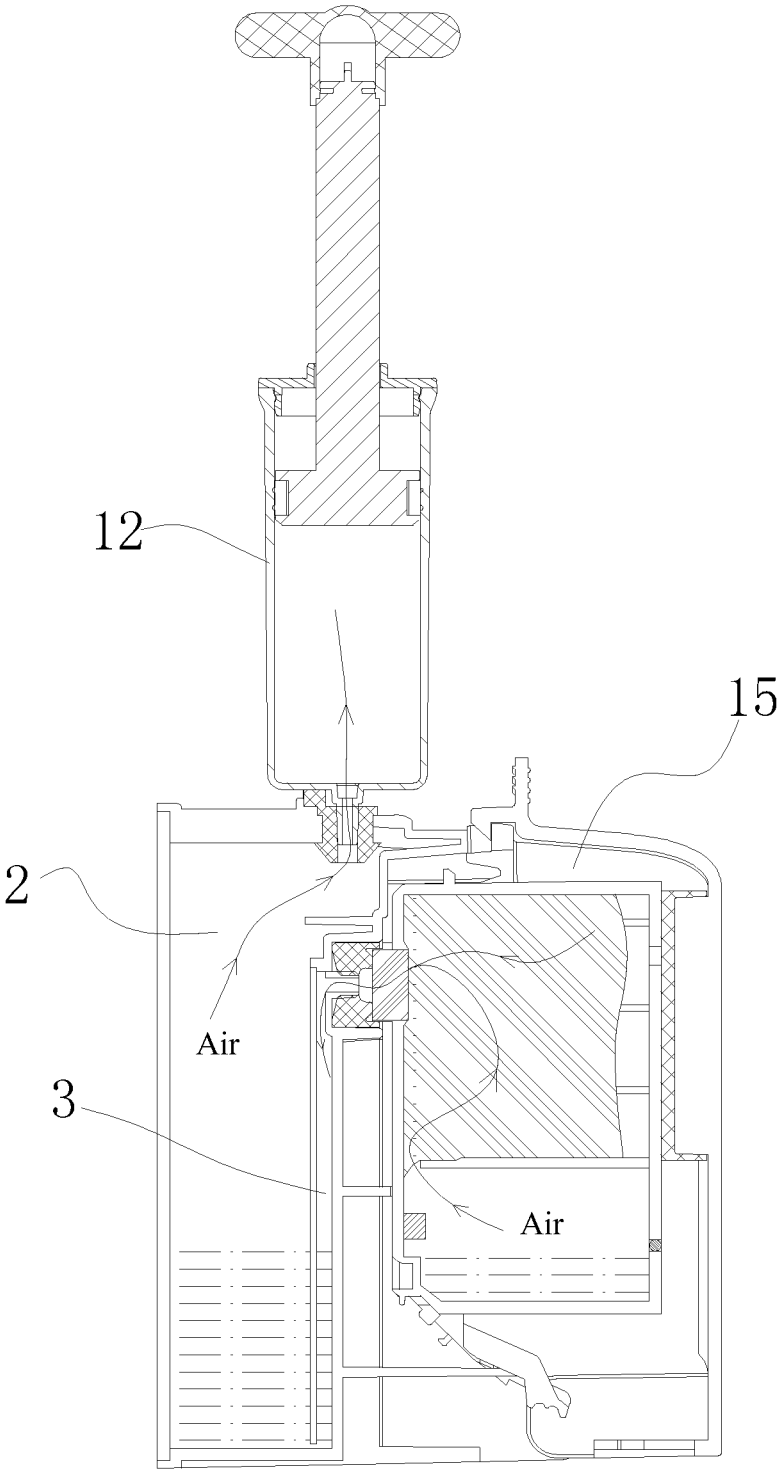
FIG. 4*e* is a schematic diagram illustrating the state after ink is initially injected into the ink cartridge to be refilled by the ink cartridge refilling device in the embodiment of the invention.

(5) As illustrated in FIG. 4*d*, loosening the handle 122 of the aspirator 12. Herein, the piston 123 slowly moves down due to the action of the atmospheric pressure according to the gas-pressure balance principle of the closed space, so that the ink in the ink container 2 is driven to enter into the ink cartridge 15 via the ink inlet end 32, the outlet end 31 and the ink outlet 154 along the directions shown by the arrowheads. As the communicating opening 1531 is disposed under the ink outlet 154 here, the ink may flow into the ink cavity 152 via the communicating opening 1531 under the action of the gravity and be maintained under the ink cavity 152.

(6) Then, pulling the aspirator 12 again for suction. And herein, the air above the upper part of the ink cavity 152 is sucked along the directions shown by the arrowheads illustrated in FIG. 4*e*. After that, loosening the aspirator 12. And similarly, the ink in the ink container 2 is injected into the ink cartridge 15 and preferably injected into the ink cavity 152.

Figure 4F:
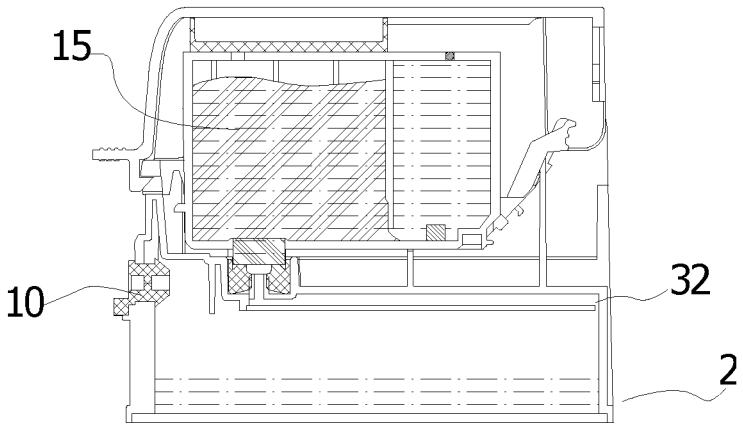
FIG. 4*f* is a location diagram illustrating the state when the ink cartridge refilling device in the embodiment of the invention ends the ink injection operation.

(7) The above process is repeated until the ink cartridge 15 is fully refilled with the ink. Herein, removing the aspirator 12 and sealing the suction channel 4 again via the self-closed seal ring 10. Subsequently, rotating the whole ink cartridge refilling system counterclockwise at an angle of 90 DEG, so that the inlet end 32 is disposed above the ink level surface of the ink container 2 again as illustrated in FIG. 4*f*.

(8) Herein, opening the upper cover 6; removing the ink cartridge 15; and using the previous components such as the rubber plug and the sleeve to seal the outlet end 31 again. If a chip is arranged on the ink cartridge 15, a chip restorer is required to be used for restoring the information in the chip.

It can be seen from the above refilling process that: the ink cartridge refilling system must be rotated when the ink cartridge 15 is refilled until the outlet end 32 of the ink injection channel 3 is disposed on the upstream of the ink-flow gravity direction of the ink cartridge 15, namely the ink outlet 154 connected with the outlet end 31 is disposed above the communicating opening 1531. Therefore, in the case of ink refilling, the ink injected into the ink cartridge 15 may flow to the communicating opening 1531 from the ink outlet 154 along the ink-flow gravity direction, enter into the ink cavity 152, and be gathered on the upper part of the ink cavity 152. Consequently, only the air on the upper part of the ink cavity 152 is communicated with the communicating opening 1531, and then the aspirator 12 can only suck the air in the ink cavity 152 and cannot suck the ink injected into the ink cavity 152 in the case of suction for a plurality of times, and thus guarantee can be made that the ink cavity 152 and the ink cartridge be easy to be fully injected.

Figure 5:
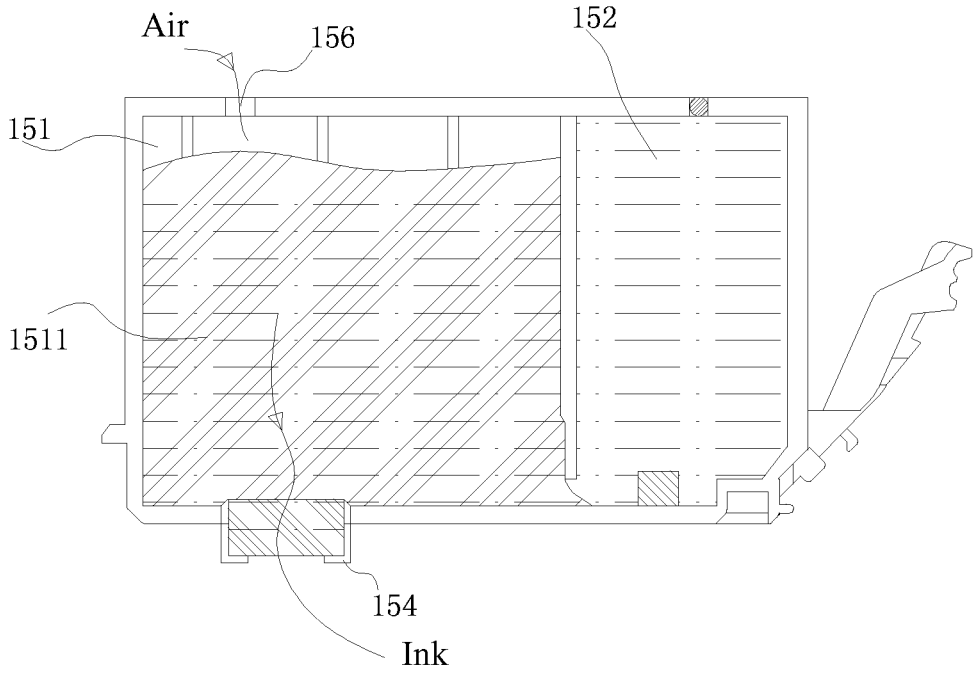
FIG. 5 is a schematic diagram illustrating the ink flow state after the ink cartridge in the embodiment of the invention is refilled and before the ink cartridge is removed (regardless of the ink cartridge refilling device).

It can be seen from the above refilling process that: after the ink cartridge 15 is refilled, the ink cartridge 15 must be rotated until the inlet end 32 is disposed above the ink level surface of the ink container 2, and then the ink cartridge 15 can be removed. The reason is as follows: due to the friction force between the piston 123 and the cylinder 121 of the aspirator 12, the piston 123 cannot move back to the position when the aspirator 12 is not used after the ink cartridge 15 is refilled, namely there is certain negative pressure in the ink container 2. After the ink cartridge 15 is refilled, there is all ink in the ink injection channel 3, namely the inlet end 32 is immersed into the ink, and thus there is very low negative pressure or almost no negative pressure in the ink cartridge 15 under the action of water resistance. Therefore, if the ink cartridge 15 is directly removed here, the phenomenon of ink drop tends to occur as the sponge 1511 is still in the saturated or oversaturated state. However, if the ink cartridge 15 is removed after rotation, as there is air in the ink injection channel 3 here and the ink container 2 is communicated with the ink cartridge 15, there is very large negative pressure in the ink cartridge 15 as well, and then the outside air may enter into the negative-pressure cavity 151 when the upper cover 6 is opened, and thus residual ink in the sponge 1511 may flow to the ink container 2 here due to the material balance principle and the sponge 1511 is in the unsaturated state as illustrated in FIG. 5, and consequently the phenomenon of ink drop may not occur when the ink cartridge 15 is removed.

It shall be noted that: the sucking opening 41 and the inlet end 32 shall be respectively disposed on or close to two relative sidewalls on the ink container 2, namely the sucking opening 41 and the inlet end 32 are always arranged relative to each other and distributed on both sides of the ink container 2. Therefore, when the ink cartridge refilling system is used for refilling the ink cartridge 15, guarantee can be made that the inlet end 32 be immersed into the ink after rotation and the ink be refilled into the ink cartridge 15 no matter the ink cartridge refilling system is clockwise rotated or counterclockwise rotated in the beginning of refilling.

It shall be understood by those skilled in the art that the ink cartridge to be refilled can also be an ink cartridge provided with no ink cavity and only a sponge.

In summary, the inlet end 32 of the ink injection channel 3 is disposed above the ink level surface of the ink container 2; the outlet end 31 is disposed on the upstream of the ink-flow gravity direction of the ink cartridge 15 in the case of refilling; the ink cartridge 15 must be rotated after refilling and removed when the inlet end 32 of the ink cartridge refilling device 1 is disposed above the ink level surface of the ink container 2, so that the ink injected into the ink cartridge 15 cannot be sucked out again in the case of suction for a plurality of times, and thus guarantee can be made that the ink cartridge be fully refilled with the ink and no superabundant air bubbles be left over. Therefore, the phenomenon that the sponge is in the saturated or oversaturated state when the ink cartridge is removed can be avoided; the phenomenon of ink drop can be avoided; and guarantee can be made that the phenomenon of ink splash when the refilling device after long-distance transport is initially used by the user be avoided.

It shall be finally noted that the above embodiments are only used for illustrating the technical proposal of the invention and not intended to limit the invention. Although detailed description is given to the invention with the preferred embodiments, it shall be understood by those skilled in the art that the technical proposals illustrated in various embodiments can also be modified or partial technical characteristics can be subjected to equivalent replacement; and the modifications or replacements shall not allow the essence of corresponding technical proposals to be departed from the spirit and scope of the technical proposals of various embodiments of the invention.

The invention claimed is:

1. A negative-pressure ink cartridge refilling device for refilling ink into an ink cartridge to be refilled, comprising:

an ink container, in which said ink container used for storing the ink to be refilled into said ink cartridge to be refilled;

an ink injection channel, in which said ink injection channel used for conveying the ink to said ink cartridge to be refilled; one end of said ink injection channel being an inlet end through which the ink in said ink container enters into said ink injection channel and the other end of said ink injection channel being an outlet end connected with said ink cartridge to be refilled; and when the ink cartridge is placed on the ink cartridge refilling device, said inlet end disposed above the ink level surface of said ink container;

an aspirator, in which said aspirator used for sucking air in said ink cartridge refilling device; and a suction channel, in which said suction channel communicated with said ink container and provided with a sucking opening connected with said aspirator;

wherein said negative-pressure ink cartridge refilling device also comprises an ink cartridge positioning mechanism connected with said ink container and used for fixing said ink cartridge to be refilled into said ink cartridge refilling device;

wherein said negative-pressure ink cartridge refilling device also comprises an upper cover connected with said ink cartridge positioning mechanism; and a sealing component used for hermetically fixing said ink cartridge into said ink cartridge refilling device is also arranged on said upper cover.

2. The negative-pressure ink cartridge refilling device according to claim 1, wherein said inlet end and said sucking opening are respectively adjacent to or disposed on two opposite sidewalls on said ink container.

3. The negative-pressure ink cartridge refilling device according to claim 1, wherein a clamping groove is formed on one sidewall of said ink cartridge positioning mechanism.

4. The negative-pressure ink cartridge refilling device according to claim 1, wherein said ink cartridge positioning mechanism and said ink container are either molded together as one part or joined by welding or clamping.

5. The negative-pressure ink cartridge refilling device according to claim 1, wherein one end of said upper cover is articulated with one end of said ink cartridge positioning mechanism and the other end of said upper cover is provided with a clamping fastener engaged with said clamping groove.

6. The negative-pressure ink cartridge refilling device according to claim 1, wherein a sealing mechanism used for sealing is arranged at said outlet end and consists of a seal ring, a rubber plug and a sleeve; a recess is formed inside said seal ring and engaged with said rubber plug; and said sleeve is engaged with said rubber plug.

7. The negative-pressure ink cartridge refilling device according to claim 1, wherein said sucking opening is provided with a self-closed seal ring used for sealing.

8. A negative-pressure ink cartridge refilling system, comprising said ink cartridge to be refilled and said negative-pressure ink cartridge refilling device according to claim 1, and the ink cartridge is divided into a negative-pressure cavity and an ink cavity via a partition wall; and the negative-pressure cavity and the ink cavity are connected with each other via a communicating opening disposed under the partition wall, and the negative-pressure cavity includes an absorbing member for holding ink and an ink outlet for supplying ink to a printhead of a printer.

9. The negative-pressure ink cartridge refilling system according to claim 8, wherein said outlet end is disposed on the upstream along the ink-flow direction from the ink outlet to the communicating opening of said ink cartridge in the case of refilling.

10. The negative-pressure ink cartridge refilling system according to claim 8, wherein said outlet end is connected with said ink outlet.

11. A method for utilizing said negative-pressure ink cartridge refilling system according to claim 10 for refilling, comprising the following steps of:

A. rotating said negative-pressure refilling system until the ink outlet of the ink cartridge is disposed above the communicating opening;

B. allowing said aspirator to be connected with said sucking opening for negative-pressure ink injection; and C. rotating said negative-pressure refilling device until said inlet end is disposed above the ink level surface of said ink container.

12. The refilling method according to claim 11, wherein said step B comprises the following steps of:

a. pulling said aspirator to suck air in said ink container; and b. loosening said aspirator, in which said ink cartridge to be refilled automatically absorbs the ink in said ink container due to the gas-pressure balance.

13. The refilling method according to claim 11, wherein said refilling method also comprises step D after said step C: removing said ink cartridge from said ink cartridge refilling device and sealing said outlet end via a sealing mechanism.

14. The refilling method according to claim 13, wherein said sealing mechanism is arranged at said outlet end and consists of a seal ring, a rubber plug and a sleeve; a recess is formed inside said seal ring and engaged with said rubber plug; and said sleeve is engaged with said rubber plug.

15. The negative-pressure ink cartridge refilling device according to claim 1, wherein the ink cartridge is divided into a negative-pressure cavity and an ink cavity via a partition wall; and the negative-pressure cavity and the ink cavity are connected with each other via a communicating opening disposed under the partition wall, and the negative-pressure cavity includes an absorbing member for holding ink and an ink outlet for supplying ink to a printhead of a printer; and wherein said outlet end is connected with the ink outlet of the ink cartridge, and the ink outlet is disposed above the communicating opening when the refilling device is used to refill the cartridge.

16. The negative-pressure ink cartridge refilling device according to claim 1, wherein the suction channel and the ink injection channel are respectively arranged at different positions of the ink container.

* * * * *